US010567096B1

(12) United States Patent
Bickers et al.

(10) Patent No.: US 10,567,096 B1
(45) Date of Patent: Feb. 18, 2020

(54) GEOMETRIC RADIO TRANSMISSION SYSTEM AND METHOD FOR BROADCASTING AUDIO TO A LIVE AUDIENCE

(71) Applicants: Michael T. Bickers, Lincoln, CA (US); David Hakim, Ridgecrest, CA (US)

(72) Inventors: Michael T. Bickers, Lincoln, CA (US); David Hakim, Ridgecrest, CA (US)

(73) Assignee: Muteflix Media Technologies, Inc., Lincoln, CA (US)

( * ) Notice: Subject to any disclaimer, the term of this patent is extended or adjusted under 35 U.S.C. 154(b) by 0 days.

(21) Appl. No.: 15/725,789

(22) Filed: Oct. 5, 2017

(51) Int. Cl.
*H04H 20/61* (2008.01)
*H04H 20/72* (2008.01)
*H04R 1/10* (2006.01)

(52) U.S. Cl.
CPC ..... *H04H 20/61* (2013.01); *H04H 20/72* (2013.01); *H04R 1/1041* (2013.01); *H04R 2420/07* (2013.01)

(58) Field of Classification Search
CPC ..... H04W 76/40; H04L 65/4076; H04L 65/4084; H04L 65/604; H04L 67/34; H04L 9/3215; H04R 1/406; H04R 3/005; H04R 2499/13; H04R 2201/401; A63F 2300/577; B60N 2002/0268; B60N 2/501; H04M 1/72569; G10K 11/18; H04Q 2209/40; H04S 7/302; H04S 7/303; H04S 7/304
USPC ..... 455/404.2, 3.06
See application file for complete search history.

(56) References Cited

U.S. PATENT DOCUMENTS

2017/0245344 A1* 8/2017 Child ..... H05B 37/0218
2018/0202686 A1* 7/2018 Ahuja ..... G05B 15/02

* cited by examiner

*Primary Examiner* — Tu X Nguyen
(74) *Attorney, Agent, or Firm* — Richard A. Ryan

(57) ABSTRACT

A system and method for transmitting the audio component of a performance, such as a movie, to audience members located in the listening area of a venue, such as a movie theater, to improve the quality of the audio experience and reduce problems with other noise activity interfering with the performance. The system and method use the location of the occupied seats, geometry of the venue and the audience density to produce a structured operating envelope that is utilized to more efficiently and effectively broadcast an audio signal, which comprises the audio component of the performance, to individual audience members. The audio signal is received by a smart phone or other electronic device associated with one or more audience members. The audio component is transferred to headphones, ear buds or other devices worn by an audience member and connected, wired or wirelessly, to the electronic device.

20 Claims, 5 Drawing Sheets

GEOMETRIC RADIO TRANSMISSION SYSTEM AND METHOD FOR BROADCASTING AUDIO TO A LIVE AUDIENCE

BACKGROUND OF THE INVENTION

A. Field of the Invention

The present invention relates generally to media transmission systems and methods that are specially configured for broadcasting audio signals to a live audience that receives the audio signal in a listening area of a venue, such as a theater, concert hall, stadium or the like. In particular, the present invention relates to such media transmission systems and methods that broadcast audio signals to members of a live audience that hear the audio through headphones or other listening devices. Even more particularly, the present invention relates to such systems and methods that beneficially take into account the location of the persons in the listening area to more efficiently and effectively broadcast the audio signal to each audience member.

B. Background

Many people enjoy going to a theater, concert hall, stadium or other venue to watch and listen to a movie, play, opera, concert, dance, motivational speaker, comedian or other type of performance. The venue where a performance takes place may be an interior room of a building or at an outdoor location, such as a field or the like. As well known in the art, the people watching and listening to the performance at the venue comprise an audience that is made up of a plurality of individual audience members who are each, at least to one extent or another, watching and listening to the performance. As is also generally well known, the venue for a performance may be configured such that audience members sit or are otherwise positioned in assigned seating, as is common for plays, operas, comedic acts and the like, or the venue may be configured for a first-come, first-serve type of seating arrangement, as is generally common for movie theaters, stadiums, fields and the like (although some movie theaters are changing to assigned seating). Unfortunately, how well an individual audience member can see and/or hear the performance often depends on where he or she is sitting in the venue. Often, but by no means always, a venue will have a higher or lower ticket price for a performance that is based, at least to some extent, on the seat or seating area where the audience member will sit.

One aspect of nearly every performance is the need to transmit audio signals to the audience members in the venue. The typical performance venue has audio broadcast equipment that transmits the sound waves throughout the portion of the venue where the audience is or may be located, referred to herein generally as the "listening area". Ideally, the audio equipment is arranged in the venue and/or the venue is acoustically configured in a manner that results in every audience member in the listening area having a good, preferably excellent, audio experience during the performance. In reality, however, virtually every venue has seating locations (which are the specific locations in the listening area where audience members may sit or otherwise be located) that are better or worse than other seating locations with regard to being able to receive the audio signals generated by the audio equipment. As such, the seating location of an individual audience member in the venue will result in a different, sometimes very different, audio experience from other audience members based on his or her seating location in the venue. Due to the movement and interaction of audio/sound waves through a venue, however, it is not always intuitively obvious to most audience members where in the venue he or she is likely to have the best possible audio experience. As such, most people pick their seating location independent of where, at least in actuality, the audio experience is likely to be best.

Most serious performance venues tend to spend a significant amount of money installing and modifying audio equipment in an attempt to provide every audience member with a very high quality audio experience. Even smaller lower funded venues, such as older movie theaters and the like, tend to put some effort into having an audio system that can add to (as opposed to take away from) the movie-watching or other performance experience. In addition, many performance venues are specifically designed with the acoustics taken into consideration so as to enhance the likelihood that each audience member will have a good quality audio experience. Despite these efforts and expenditures, the reality of sound waves moving through the audience portion of the venue, crashing into and interfering with each other and into the walls (as applicable) of the venue or beyond the boundaries of an outdoor venue, tends to result in seating locations in the venue that are much better, if not significantly better, than other seating locations in the venue. As stated above, although certain sound experts may be able to ascertain where in a particular venue is likely to receive the best audio experience, most audience members cannot and, as a result, the quality of their audio experience is usually left to chance.

In addition to issues with regard to the quality of the audio equipment, venue configuration and seating location, another limiting factor with an audience member being able to obtain a high quality audio experience during a performance is non-audio noise activity, including from other audience members. As will be readily appreciated by persons who are skilled in the art, it is not uncommon for an audience member to be engaged in some type of noise activity during a performance that detracts from other audience members being able to have a high, or often even good, quality audio experience. The noise activity may be talking, whispering, coughing, sneezing, eating food out of packages (popcorn, chips and the like), movement of chairs and other such sources of noise. Unfortunately, the noise activity may happen at a point during the performance that coincides with an important, or even crucial, audio portion of the performance. Although most audience members do not engage in any significant noise activity, at least not intentionally, most people will generally agree that nearly every single performance has one or more audience members, often much more than one, that intentionally or unintentionally engage in noise activity that negatively impacts the ability of other audience members to have a high quality audio experience.

For many years, many people have utilized headphones, ear buds and other personal or single user listening devices to direct audio signals to their ears so that they, individually, may hear the audio signal. In general, such devices have electroacoustic transducers that convert electrical signals to sound. Single user listening devices may be of the headphone type that have an elongated band that is configured to, at least generally, go over the user's head to position the speaker portion of the headphones at the user's ears. Ear buds and the like comprise small individual units that are sized and configured to be placed in, or at least near, the user's ear canal. In one configuration, a single user listening device has one or more electrical wires that electronically connect the electroacoustic transducers to an audio source, typically via an appropriate audio plug or the like, that produces the electrical signals that are converted to sound by a listening device. In another configuration, a single user listening device may be cooperatively configured with the audio source so the device can wirelessly connect to the audio source, such as by Bluetooth® or the like wireless signal. In the past, the typical audio source was a radio, tape deck, record player, television, portable media player (iPod®, MP3 players, etc.) or the like. Although headphones, ear buds and other single user listening devices are still utilized for the above-described audio sources, it is very likely that such devices are more commonly utilized with smart phones, tablets, mini-tablets and like electronic devices, which are capable of receiving, storing and playing a wide variety of audio recordings. As well known in the relevant art, the above referenced electronic devices are capable of receiving an audio signal that is transmitted to the electronic device via a wireless radio frequency network, such as a cellular telecommunications system, wifi or the like, and then allowing the user to hear that audio signal through headphones, ear buds or other single user listening devices connected to (wired or wirelessly) to the electronic device.

Most people consider headphones, ear buds and other single user listening devices as being able to allow the user to better hear the sound that is being played by the audio source due to the improved delivery of the audio signal to the user's ears relative to speakers that broadcast an audio signal to the open air. In addition to improved sound quality, many people enjoy utilizing single user listening devices because use of such devices tends to substantially reduce the likelihood that noise activity will interfere with the person's enjoyment of the music or other sound from the audio source. Despite the fact that receiving and listening to an audio signal through a single user listening device has advantages that may be applicable to performances, it is believed to be mostly unknown for an audience member to be able to utilize a single user listening device in a public venue, such as a movie theater, stadium or the like, to listen to a performance that is taking place while the person is in the audience at the venue. This is due, at least in part, to the difficultly of efficiently and effectively delivering the audio signal to all of the audience members at the venue who may desire to listen to the words, music and other sounds associated with the performance through a single user listening device.

Despite the various prior art attempts to improve the audio experience of each of the individual audience members of an audience at a performance, there exists a substantial need for an improvement with regard to broadcasting audio signals to the live audience of a performance. Specifically, there exists a need for a new system and method of delivering audio signals to audience members so that each of the audience members will have a good audio experience while listening to a performance at a venue. The new system and method should be configured to deliver the same high quality audio experience to each audience member at a performance, regardless of the type, size and configuration of the venue or noise made by other audience members during the performance. The new system and method of delivering audio signals to audience members in a venue should be configured to take into account the size and configuration of the venue, the location of the venue's listening area, the number of audience members at the performance and where in the listening area the seating locations are occupied by audience members. Preferably, the new system and method should be adaptable for use with a wide variety of different types of venues, listening areas and performances. The new system and method should be structured and arranged to be easy for the audience members to use while listening to a performance.

SUMMARY OF THE INVENTION

The audio broadcasting system and method of the present invention provides the benefits and solves the problems identified above. That is to say, the geometric radio transmission system and method for broadcasting audio to a live audience of the present invention is structured and arranged to be utilized with a venue to more effectively and efficiently broadcast an audio signal to an audience listening to a live performance (which may or may not have a visual aspect) at a venue. Specifically, the new audio broadcasting system and method of the present invention provides a more effective and efficient manner of delivering audio signals to audience members so that each audience member will have a high quality audio experience while listening to a performance at a venue. More specifically, the new system and method of the present invention is able to deliver a high quality audio experience to each audience member at a performance in a venue, regardless of the type, size and configuration of the venue, where the audience member sits in the venue, noise made by other audience members during the performance, and other factors that could otherwise negatively impact the ability of each audience member to have a high quality audio experience. The new system and method for broadcasting audio signals to audience members in a venue accomplishes the above by taking into account the size and configuration of the venue, the location of the venue's listening area, the number of audience members who are attending the performance, and where in the listening area the seating locations are actually occupied by an audience member. The new system and method of the present invention is adaptable for use with a wide variety of different types of venues, listening areas and performances. In the preferred embodiments, the new system and method of the present invention is structured and arranged to be easy for audience members to use while listening to a performance.

In one of the preferred embodiments of the present invention, the new audio broadcasting system generally comprises a performance having an audio component, a venue for the performance, a listening area in the venue, an audience comprising a plurality of audience members seated or otherwise located in the listening area of the venue, and a plurality of seating locations in the listening area of the venue. Some or all of the seating locations have an audience member and are referenced as occupied seating locations. The system also comprises a locating mechanism associated with the venue for locating the occupied seating locations in the listening area, a media transmission device associated with the venue and operatively connected to the locating mechanism to receive the location of the occupied seating locations, a wireless radio frequency network electronically connected to the media transmission device, an electronic device associated with one or more of the audience members, and a single user listening device, such as headphones or ear buds, associated with each audience member that is connected to an electronic device to deliver the audio component of the performance directly to the audience member (i.e., to or near his or her ears) in a manner that reduces the likelihood of noise activity, such as from other audience members, disturbing the enjoyment of the performance by the audience member. The venue has an audio control center that is configured to control the audio component of the performance. The locating mechanism can comprise data provided from an audience management system of the venue (particularly when the venue has assigned seating), manual determination or a LiDAR sensor. In a preferred configuration, the locating mechanism comprises the LiDAR sensor, with the LiDAR sensor being configured to also determine a venue geometry of the venue that can be utilized by the media transmission device to produce the structured operating envelope. The media transmission device is configured to receive the audio component of the performance to produce an audio signal and to receive the occupied seating locations from the locating mechanism to produce a structured operating envelope. The wireless radio frequency network is structured and arranged to broadcast the audio signal to the listening area of the venue based on the configuration of the structured operating envelope. The electronic device is structured and arranged to receive the audio signal from the wireless radio frequency network and process the audio signal back into the audio component of the performance.

In a preferred configuration, the media transmission device utilizes venue geometry and audience density to produce the structured operating envelope. As set forth above, in one embodiment the media transmission device receives the venue geometry from the locating mechanism and the locating mechanism is a LiDAR sensor that will scan the listening area of the venue. The system will also have an audio conversion software configured to process the audio component into the audio signal, a structured operating envelope software that produces the structured operating envelope and an audio stream broadcasting software that prepares the audio signal for broadcasting by the wireless radio frequency network. Typically, the audio conversion software, structured operating envelope software and audio stream broadcasting software are operated by the media transmission device. The electronic device is typically a smart phone, tablet, mini tablet or the like device that is capable of receiving and storing software and capable of receiving and playing an audio signal through headphones, ear buds or the like.

In one of the preferred embodiments of the present invention, the new method of audio broadcasting generally comprises the steps of: (a) providing a performance having an audio component; (b) providing a venue having a listening area with a plurality of seating locations for the performance; (c) admitting an audience having a plurality of audience members into the listening area of the venue with the audience members occupying some or all of the seating locations to produce occupied seating locations; (d) determining location of the occupied seating locations utilizing an audience member locating mechanism; (e) receiving the audio component of the performance into an audio control center; (f) utilizing a media transmission device to produce an audio signal from the audio component of the performance and a structured operating envelope based on occupied seating locations, venue geometry and audience density; (g) delivering the audio signal to a wireless radio frequency network; (h) broadcasting the audio signal to the listening area of the venue based on the structured operating envelope produced by the media transmission device; (i) receiving the audio signal by an electronic device associated with one or more audience members; (j) processing the audio signal back into the audio component by the electronic device; and (k) transferring the audio component to one of the audience members with a single user listening device for a high quality listening experience that substantially eliminates noise activity.

Accordingly, the primary object of the present invention is to provide a new audio broadcasting system and method that has the various advantages set forth above and which overcomes the disadvantages and limitations associated with presently available apparatuses, systems and methods for broadcasting audio signals to audience members while listening to a live performance at a venue.

It is an important object of the present invention to provide a new system and method for delivering audio signals to audience members so each of the audience members will have a high quality audio experience while listening to a performance at a venue that takes into account the type, size and configuration of the venue, eliminates issues with noise made by other audience members during the performance, and prevents other factors from negatively impacting the ability of each audience member to have the high quality audio experience.

An important aspect of the present invention is that it provides a new system and method of broadcasting audio signals that accomplishes the objectives set forth above and elsewhere in the present disclosure.

Another important aspect of the present invention is that it provides a new system and method of broadcasting audio signals to a live audience listening to a performance at a venue that provides a more effective and efficient manner of delivering the audio signals to the listening area of the venue to ensure that each audience member of the audience will have a high quality audio experience while listening to the performance.

Another important aspect of the present invention is that it provides a new system and method of broadcasting audio signals to a live audience listening to a performance at a venue that takes into account factors such as the type, size and configuration of the venue when delivering the audio signal to the members of the audience in the listening area that are listening to the performance.

Another important aspect of the present invention is that it provides a new system and method of broadcasting audio signals to a live audience listening to a performance at a venue that is configured to reduce the likelihood that noise activity which occurs during the performance will affect the listening experience of the audience members.

Another important aspect of the present invention is that it provides a new system and method of broadcasting audio signals to a live audience listening to a performance at a venue that is configured to minimize the likelihood that any sound interference factors resulting from the shape or configuration of the venue will negatively impact the ability of each audience member to have a high quality audio experience during the performance.

Another important aspect of the present invention is that it provides a new system and method for broadcasting audio signals to audience members in a venue which takes into account the number of audience members who are at the performance and where in the venue's listening area the seating locations are occupied by an audience member.

Another important aspect of the present invention is that it provides a new system and method for broadcasting audio signals to audience members in a venue which is readily adaptable for use with a wide variety of different types of venues, listening areas and performances.

Yet another important aspect of the present invention is that it provides a new system and method for broadcasting audio signals to audience members in a venue which is easy for audience members to use while they are listening to a performance.

As will be explained in greater detail by reference to the attached figures and the description of the preferred embodiment which follows, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures are illustrative of one or more preferred embodiments and, therefore, are included to represent several different manners of configuring the present invention. Although specific components, configurations and uses are illustrated, it should be understood that a number of variations to the components and to the configuration and use of those components described herein and shown in the accompanying figures can be made without changing the scope and function of the invention set forth herein. For instance, although the description and figures included herewith generally describe and show particular types of components and configurations or uses for those components in the new radio transmission system and method of the present invention, those skilled in the art will readily appreciate that the present invention is not limited to these components and/or configurations. In addition, the exemplary embodiments of the present apparatus are shown and described herein with only those components that are required to disclose the present invention. As such, many of the necessary elements for connecting and using the various components of the present invention are not explicitly shown or necessarily described below, but which are well known to persons who are skilled in the relevant art. As will be readily appreciated by such persons, the various elements of the present invention that are described below may take on any form consistent with those that are readily realized by a person of ordinary skill in the art having knowledge of performance venues, performances, electronic devices, single user listening devices and the like.

Figure 1:
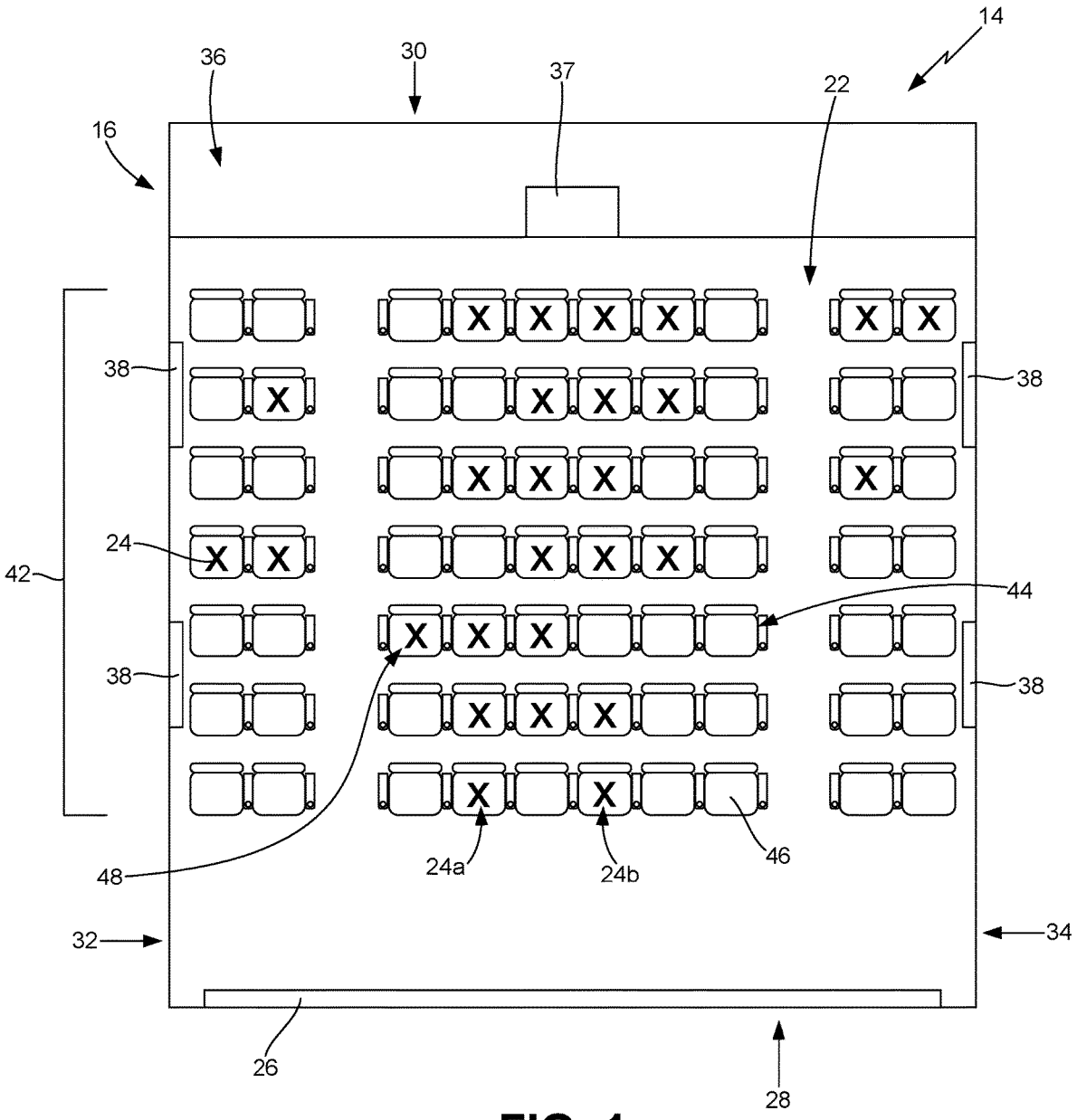
FIG. 1 (PRIOR ART)
FIG. 1 is a top plan view of a prior art venue having a plurality of seating locations in a listening area of the venue, with the venue shown as a movie theater and some seating locations shown as being occupied by an audience member.
Figure 2:
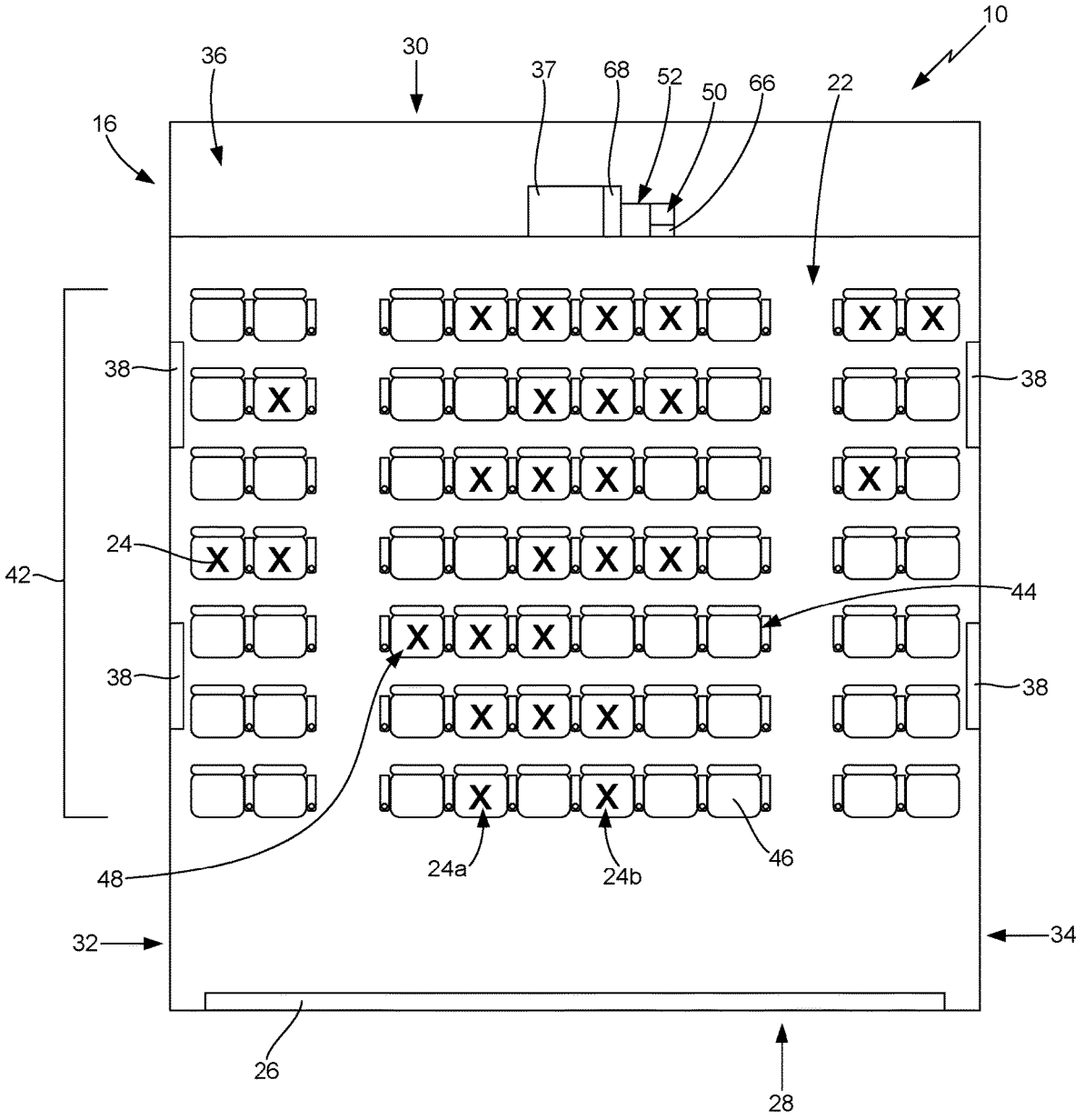
FIG. 2 is a top plan view of the venue, seating area and audience members of FIG. 1 configured with a geometric radio transmission system that is configured according to a first embodiment of the present invention to generate an audio signal based on the occupied seating locations of the audience members.
Figure 3:
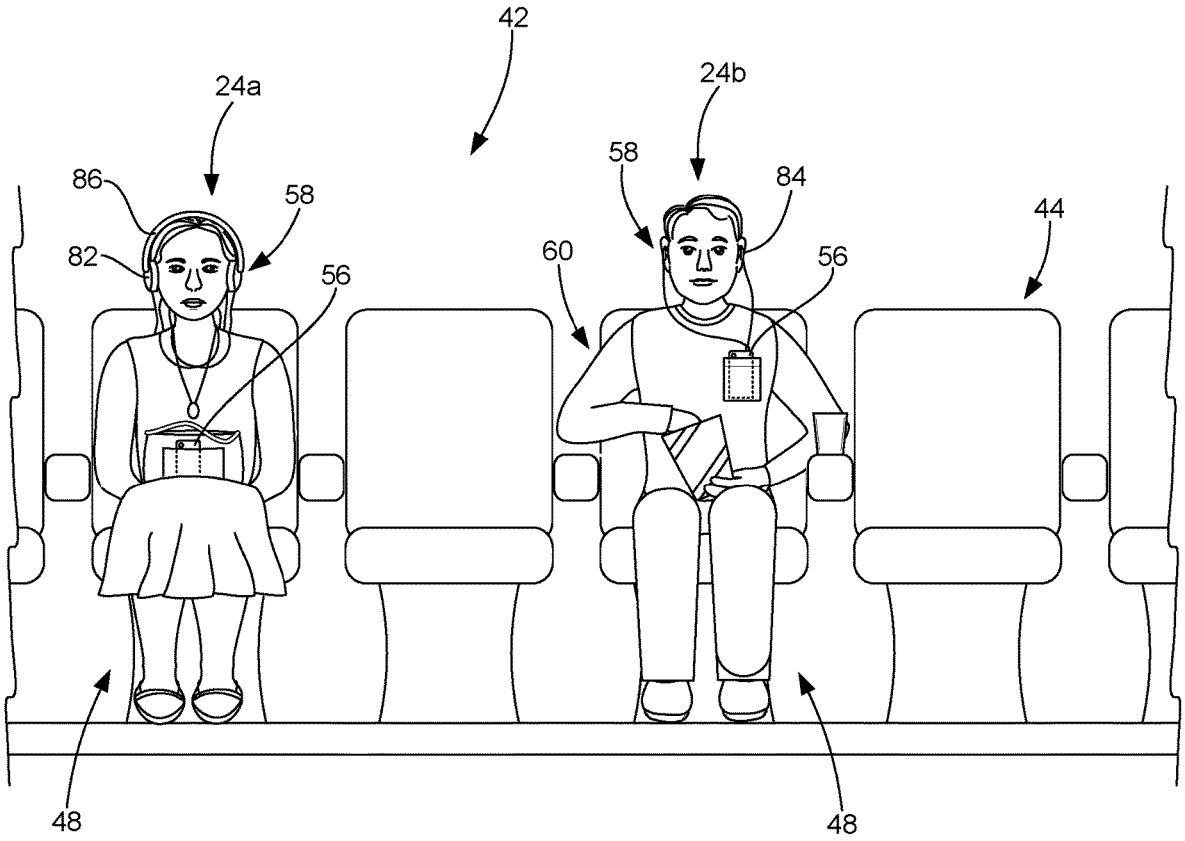
FIG. 3 is a front view of two audience members shown at a seating location of the venue of FIG. 2, with the first audience member using headphones wirelessly connected to an electronic device to listen to the audio signal generated by the geometric radio transmission system of the present invention and the second audience member using ear buds wired connected to an electronic device to listen to the audio signal.
Figure 4:
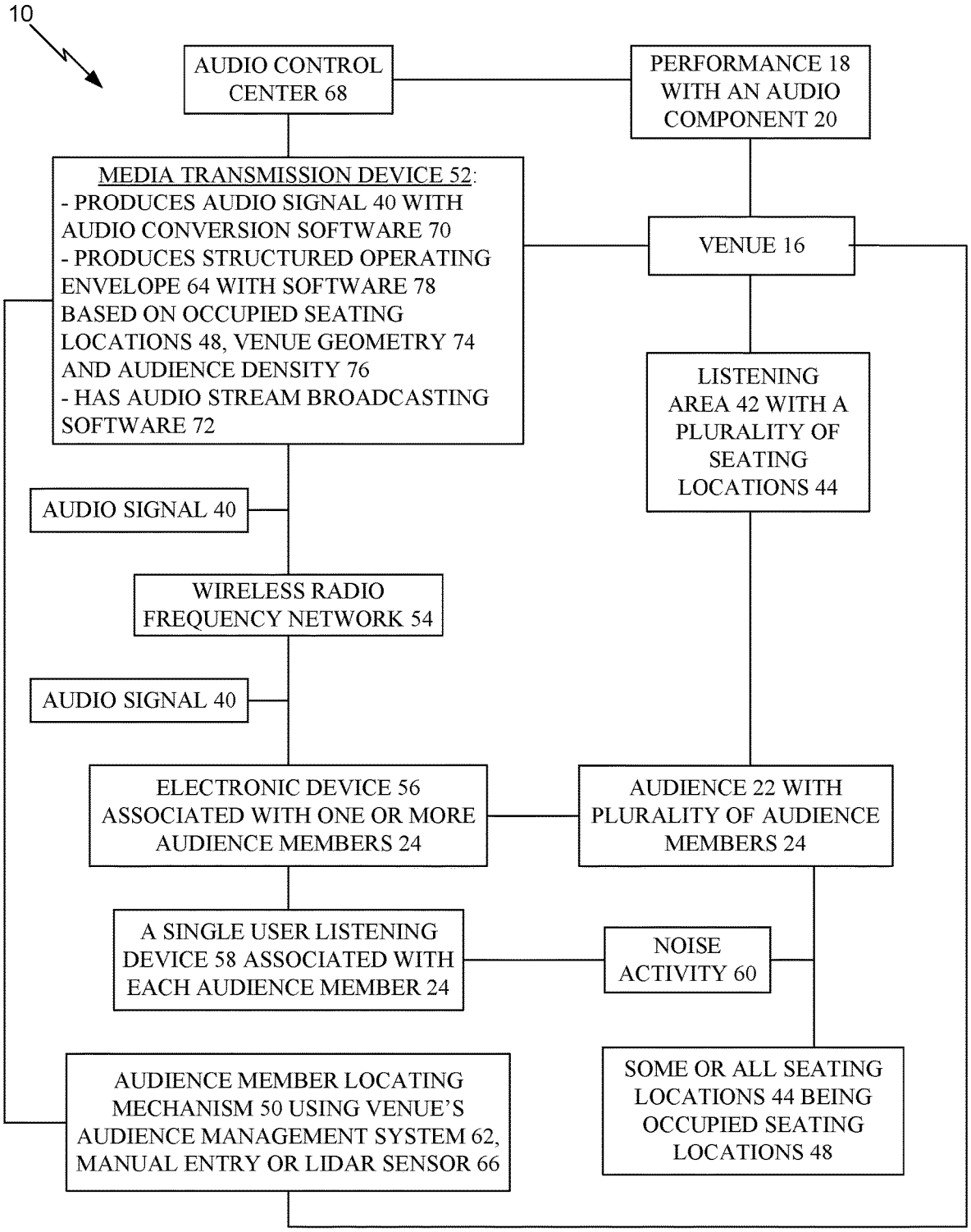
FIG. 4 is a chart showing a geometric radio transmission system configured according to a preferred embodiment of the present invention.

A geometric radio transmission system that is configured pursuant to one of the preferred embodiments of the present invention is referred to generally as 10 in FIGS. 2 and 4. A method of using the geometric radio transmission system 10 that is configured pursuant to one of the preferred embodiments of the present invention is referred to as 12 in FIG. 5. An example prior art system is shown as 14 in FIG. 1. As set forth in more detail below, the new system 10 and method 12 of the present invention are utilized with a venue 16 that is providing a performance 18 having an audio component 20 which will be heard by an audience 22 comprising one or more, typically a plurality, of audience members 24 that listen to the audio component 20 while enjoying the performance 18 at the venue 16, as best illustrated in FIGS. 1 and 2. In FIGS. 1 and 2, the venue 16 is a movie theater that is configured to show a motion picture (or movie) on a screen 26 at or near the front end 28 of the venue 16, with the venue 16 also having a back end 30, a first side 32 and a second side 34. As generally well known, a typical movie theater venue 16 has a movie theater projection center 36 generally at or near the back end 30 of the venue 16. The movie theater projection center 36 has a projector 37 that is configured to display the movie (the visual component of the performance 18—not shown in the figures) on the screen 26 to transmit, usually by wired connections, the audio component 20 of the performance 18 to the speakers 38, which are shown on the sides 32/34, so that the audio component 20 will be heard by the various audience members 24, as shown in FIG. 1. The speakers 38 broadcast an audio signal 40 that is heard by the audience members 24. The venue 16 has listening area 42, which is the area in the venue 16 that is primarily intended to receive the audio signal 40. In a venue 16 such as a movie theater, the listening area 42 comprises a plurality of seating locations 44 (each having a chair or other seat 46). For any performance 18, some or all of the seating locations 44 in the listening area 42 are occupied by an audience member 24 (the locations having an audience member 24 are shown with an "X" and identified as occupied seating locations 48 in FIGS. 1 and 2). FIG. 3 shows two audience members, shown as first audience member 24*a* and second audience member 24*b* in seats 46 that are occupied seating locations 48 for the performance 18.

For purposes of the present invention, a venue 16 may be any place where a performance 18 having at least an audio component 20 that will be heard by an audience 22 can take place. For instance, the venue 16 may be an interior room of a building, such as a movie theater, concert hall, indoor stadium and the like having one or more walls (such as the walls at the front end 28, back end 30, first side 32 and second side 34 in FIGS. 1 and 2). The venue 16 may also be an outdoor location, such as an outdoor stadium, field, park or the like that may or may not have a wall at one or more ends 28/30/32/34 of the venue 16. Audience members 24 often go to a venue 16 to watch and listen to a movie, play, opera, concert, dance, motivational speaker, comedian or other type of performance 18. For purposes of the present invention, the concern is with regard to the audio component 20 of the performance 18. Depending on the venue 16, the listening area 42 thereof may have seating locations 44 that are defined by seats 46, as shown in FIGS. 1-3, or it may have an open area where the audience members 24 will sit directly on the floor, grass, dirt or other surface (whether the audience members 24 actually sit, stand or lay down). As is generally well known, the venue 16 for any particular performance 18 may be configured for the audience members 24 to sit or otherwise be positioned in assigned seating locations 44, as is common for plays, operas, comedic acts, sporting events and the like. Alternatively, the venue 16 may be configured for first-come, first-serve type of seating, as is often the arrangement for most indoor movie theaters and for concerts and other musical performances in a stadium, field, park and the like. As set forth in more detail below, the system 10 and method 12 of the present invention are adaptable for use with any type of venue 16 that will be broadcasting the audio component 20 of a performance 18 to an audience 22 comprising audience members 24 who are seated or otherwise located in the listening area 42 of the venue 16 in order to improve the audio experience of each audience member 24.

The geometric radio transmission system 10 of the present invention generally comprises a venue 16, a performance 18 having an audio component 20, an audience 22 made up of audience members 24, an audio signal 40 that delivers the audio component 20 to each audience member 24, an audience member locating mechanism 50 that identifies which seating locations 44 in the listening area 42 are occupied seating locations 48, a media transmission device 52 that receives and processes the audio component 20 of the performance 18 based on the information from the audience locating mechanism 50, a wireless radio frequency network 54 that receives the processed audio component 20 from the media transmission device 52 and beneficially transmits the audio signal 40 to the audience members 24 in the listening area 42, an electronic device 56 associated with one or more audience members 24 that receives the audio signal 40, and a single user listening device 58 associated with each audience member 24 and electronically connected to the electronic device 56 to transmit the audio signal 40 to the audience member 24, as shown in FIGS. 2-5. The components of system 10 and method 12 are cooperatively configured to allow each audience member 24 of the audience 22 to have a high quality audio experience independent of the configuration of the venue 16, his or her location in the listening area 42 and any noise activity, shown as 60 in FIGS. 3 and 4). As set forth in the Background, the configuration of the venue 16, where in the listening area 42 the audience member 24 is located and noise activity 60 by other persons in the audience 22, or persons who are associated with the venue 16, can all negatively affect the ability of an audience member 24 to hear the audio component 20 of the performance 18 and, therefore, degrade the audience member's audio experience. This can result in the audience member 24 being unimpressed with the venue 16 and/or the performance 18. For purposes of the present invention, noise activity 60 may be any type of noise (examples of which are described in the Background and incorporated herein) that is not associated with the audio component 20 of the performance 18 and which can be heard by an audience member 24 when he or she is listening to the performance 18.

As set forth in more detail below, the new system 10 and method 12 accomplish the various objectives of the present invention by utilizing the audience member locating mechanism 50 to identify which seating locations 44, such as the seats 46, are or will be occupied by an audience member 24, processing the audio component 20 of the performance 18 and then delivering the audio signal 40 to the audience members 24 via the wireless radio frequency network 54 based on where the audience members 24 are located to ensure that each audience member 24 will receive the same high quality audio experience at the performance while better controlling the amount of resources necessary to accomplish that objective. As further set forth below, the audio signal 40 wireless transmitted by the wireless radio frequency network 54 will be received by an electronic device 56, processed by the electronic device 56 and then delivered to the ears of an audience member 24 associated with that electronic device 56 by a single user listening device 58 in a manner that will likely eliminate all noise activity 60 and improve his or her enjoyment of the performance 18.

The audience member locating mechanism 50 is configured to determine which of the numerous seating locations 44 in a listening area 42 of a venue 16 are or will be occupied seating locations 48 during the performance 18 to optimize the delivery of the audio signal 40 by the wireless radio frequency network 54. In one application, the audience member locating mechanism 50 of the new system 10 and method 12 of the present invention will utilize the venue's existing audience management system 62 to determine where the audience members 24 are or will be located during the performance. For many modern venues 16, an audience member 24 selects and/or is assigned a location (i.e., seat 46) in the listening area 42 of the venue 16 when he or she purchases their ticket. This allows the location of the various audience members 24 (i.e., the occupied seating locations 48) to be easily and quickly identified. For these venues 16, the audience member locating mechanism 50 comprises the venue's audience management system 62 to record the seat purchasing data by the audience members 24. With this data, the audience management system 62 will know the location of each audience member 24 during a performance 18, which is passed on as the audience member locating mechanism 50 for the system 10 and method 12 of the present invention. This information is utilized to configure the structured operating envelope 64 for the wireless frequency network 54. As set forth in more detail below, the structured operating envelope 64 represents the area and strength of the audio signal 40 that is delivered throughout the listening area 42 of the venue 16 during a performance 18.

Some venues 16 do not have an audience management system 62 that allows the audience members 24 to select their own seating locations 44 and do not assign seating locations 44. For such venues 16, the occupied seating locations 48 are not pre-determined and, therefore, there is no data which can be utilized by the system 10 and method 12. Such venues include most older movie theaters, fields, parks and other types of venues 16 that allow first-come, first-serve selective seating. In another configuration, the audience member locating mechanism 50 can comprise an usher or other person walking into or otherwise viewing the listening area 42 and manually identifying (i.e., by marking on a layout of the listening area 42) which seating locations 44 are occupied seating locations 48 and then directing the manually collected information to the system 10 and method 12 to configure the structured operating envelope 64 for the wireless frequency network 54. For venues 16 that do not have data available from an audience management system 62 and do not want to manually determine the occupied seating locations 48, the system 10 and method 12 of the present invention utilizes an integrated three dimensional (3D) LiDAR sensor 66, or the equivalent, to determine the occupied seating locations 48 to configure the structured operating envelope 64. As generally well known, 3D LiDAR sensors 66 (for "light detecting and ranging") are utilized to map out the surface of an area by illuminating the area with a pulsed laser light and then measuring the reflected pulses with a sensor to make a 3D representation of the area. 3D LiDAR sensors 66 are commonly utilized for geography, mapping, archeology, forestry and the like. For the present invention, the 3D LiDAR sensor 66 is utilized to map out where audience members 24 are located in the seating locations of the listening area 42 by identifying the occupied seating locations 48 in the venue 16. As with the above, the "mapping" of the occupied seating locations 48 is utilized to configure the structured operating envelope 64.

The media transmission device 52 will typically be associated with the audio control center 68 of the venue 16, which for a movie theater may be in the movie theater projection center 36, as shown in FIG. 2, and will be the source of the wireless radio frequency network 54 that is broadcast across the listening area 42 of the venue 16. The media transmission device 52 will receive the audio component 20 of the performance 18, typically via a wired connection, and process the audio component 20 into the audio signal 40 utilizing an audio conversion software 70, as shown in FIG. 4. The media transmission device 52 will also receive the data regarding the location of the occupied seating locations 48 from the audience member locating mechanism 50 to produce the structured operating envelope 64 and use this information to beneficially direct the audio signal 40 into the listening area 42 using the wireless radio frequency network 54. As set forth above, the information regarding the occupied seating locations 48 can be directed into the media transmission device 52 directly by being electronically connected to the venue's audience management system 62, manually entered by a venue employee or collected via the mapping by the 3D LiDAR sensor 66. As will be readily appreciated by persons who are skilled in the relevant art, the media transmission device 52 may be a single component or it may comprise several components that are physically separate from each other but electronically connected together, typically by use of a wired connection. In the configuration shown in FIG. 2, the media transmission device 52 has the 3D LiDAR sensor 66, the router for the wireless radio frequency network 54 and the audio conversion software 70 built in or integral therewith. In other configurations, one or more of the 3D LiDAR sensor 66 and the router for the wireless radio frequency network 54 may be physically separate from the media transmission device 52, as may be necessary or desired based on the venue 16 and/or the venue's present electronic configuration. For instance, in some circumstances it may be helpful or even necessary to place the 3D LiDAR sensor 66 at or near the front end 28 or along one of the sides 32/34 of the venue 16 to better be able to obtain the mapping of the occupied seating locations 48.

As set forth above, the audio signal 40 will be transmitted over the wireless radio frequency network 54 to the electronic devices 56 so the audience members 24 can listen to the audio component 20 of the performance 18 through a single user listening device 58, as shown in FIG. 3, to obtain a high quality audio experience from the audio signal 40. Although this may be accomplished in a wide variety of different manners, it is preferred that the media transmission device 52 also comprise an audio stream broadcasting software 72 that is configured to convert the audio component 20 of the performance into a proprietary audio signal 40 that is transferred over the wireless radio frequency network 54 to the electronic devices 56, which then converts the audio signal 40 back into the audio component 20 to be heard by the audience member 24 through the single user listening device 58 connected, wired or wirelessly, to an electronic device 56. The use of a proprietary audio signal 40 that is converted back into the audio component 20 achieves several objectives, including controlling the extent to which the audio signal 40 can be heard by other persons (including persons in other nearby or even adjacent venues 16 or persons who are outside the venue 16).

Figure 5:
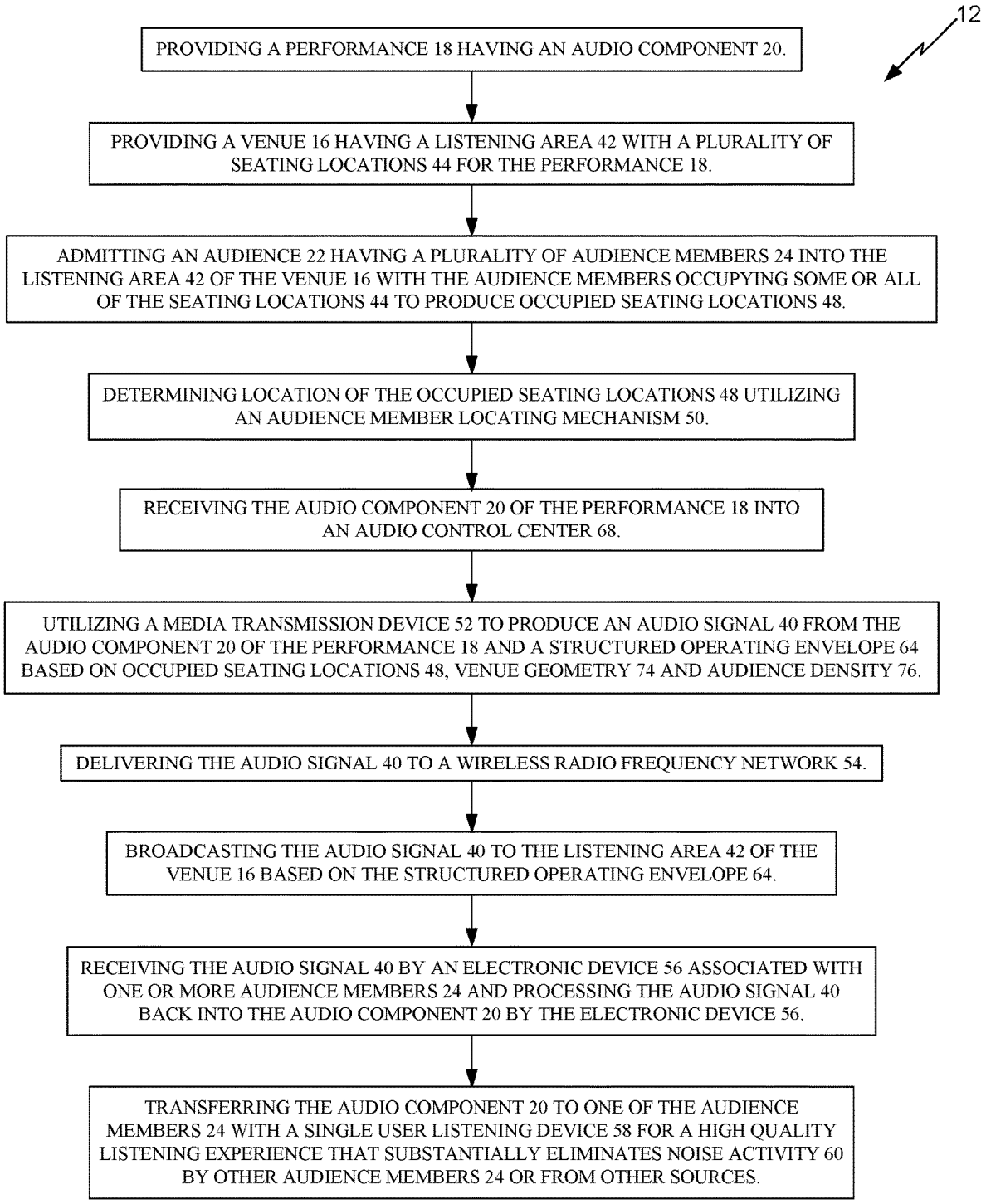
FIG. 5 is a flow chart showing a method of broadcasting audio from a performance to a live audience configured according to a preferred embodiment of the present invention, with the venue having the system of FIG. 4.

To optimize the strength and quality of the audio signal 40 received by the electronic devices 56, the structured operating envelope 64 should also take into account the venue geometry 74 and the audience density 76, as shown in FIGS. 4 and 5. The venue geometry 74 can be provided directly to the media transmission device 52 or it can be determined by the 3D LiDAR sensor 66. The audience density 76 can be calculated by the software which creates the structured operating envelope (referred to as the structured operating envelope software 78) from the audience member locating mechanism 50 (i.e., be provided by the venue audience management system 62, calculated by hand or determined by the 3D LiDAR sensor 66).

The audio conversion software 70 has three primary functions. The first function is the storage of the encoded studio audio files (the audio component 20 of the performance 18) transferred from the venue's normal audio management system combined with scheduling the appropriate audio file(s) based on the venue management system. In one embodiment, the audio conversion software 70 will operate on an English language basis. Alternatively, the audio conversion software 70 can be configured to provide other language options for the audience members 24. The option can be integrated into an electronic device mobile application on the electronic devices 56, with the audience member 24 being able to transmit his or her language selection to the media transmission device 52 from the electronic device 56 based on his or her preference. The second primary function of the audio conversion software 70 involves converting the encoded studio audio file into a file that is compatible with electronic devices 56 via proprietary compression algorithms while maintaining the quality of the original audio file for the audio component 20 of the performance 18. The proprietary compression algorithms will produce an encoded audio file that is designed for streaming via the audio stream broadcasting software 72 and in concert with any necessary video-to-audio synchronization software to insure video synchronization with a video component of the performance 18. In a preferred configuration, the media transmission device 52 is both a hardware and software based system that is specifically designed for applications which can benefit from a structured operating envelope 64. In one configuration, the audio conversion software 70 can be one of five software applications installed on the media transmission device 52 and upgradable on an automatic software update regime or manually via a remote network administrator. The final primary function of the audio conversion software 70 is the management of the integrity of the audio files that contain the audio component 20 of the performance 18 via a set of algorithms that are designed for error correction, comparison, and optimization between the original studio and the audio files on the electronic devices 56.

The operation of the media transmission device 52 with respect to the structured operating envelope 64 is one of the primary features of the system 10 and method 12 of the present invention. Although there exists many versions of audio streaming systems and combined audio-video streaming systems either in stand-alone or networked configurations, these systems transmit their audio and video on circumference based radio technology. As a result, the strength of the transmission follows a prescribed gradient, normally the further away from the source the weaker the transmission. The application of circumference based radio technology to certain venues 16, such as a movie theater and the like, would create interference between the different venues 16 of a multi-venue location (i.e., those locations having multiple theaters) during the transmission process and among the different wireless receivers of electronic devices 56.

The system 10 and method 12 of the present invention applies a different method for streaming audio over a wireless network (i.e., the wireless radio frequency network 54). By deploying a geometric based radio technology constructed from the venue's geometry 74, occupied seating locations 48, and audience density 76 via a structured operating envelope software 74. In one configuration, the media transmission device 52 integrates a series of radios that are positioned along the transmission window thereof to provide the real-time capabilities of the structured operating envelope software 78 to adjust the structured operating envelope radio transmission geometry and bandwidth density based on the occupied seating locations 48 within the structured operating envelope 64. The structured operating envelope 64 of FIG. 2 is an example of geometric based radio technology applied to a move theater venue 16 where the media transmission device 52 has access to the occupied seating locations 48, data on the audience density 76 and the venue geometry 74 (i.e., its 3D profile). The structured operating envelope software 74 constructs the radio transmission geometry and the bandwidth density matrix for the audio stream broadcasting software 72 and any necessary video-to-audio synchronization software. This process is real-time based on the location of the electronic devices 56 in the venue in comparison to the bandwidth density matrix and venue geometry 76. The second type of structured operating envelope software 78 involves venues 16 with audience management systems 62 that do not provide the audience members 24 the ability to select their seats 46 prior to sitting in the listening area 42 of the venue 16. As set forth above, other than manually determining the occupied seating locations 48, this requires the media transmission device 52 to integrate a real-time 3D LiDAR sensor 66 to provide the structured operating envelope software 78 the occupied seating locations 48 and, therefore, the data on the audience density 76 to result in similar audio performance in comparison to venues 16 that have the occupied seating locations 48 provided to the structured operating envelope software 78 in advance of the performance 18.

Although a variety of local area radio frequency networks are likely to be useable as the wireless radio frequency network 54 of the system 10 and method 12 of the present invention to broadcast the audio signal 40 to the various audience members 24, a WiFi-based local area networking system is likely to be the preferred type of network. The configuration and use of WiFi-based networks are well known in the relevant art and are likely considered to be the best system (at least presently) for the wireless radio frequency network 54.

The electronic device 56 to be utilized with the system 10 and method 12 of the present invention must be of the type that is capable of receiving the audio signal 40 from the wireless radio frequency network 54, processing the audio signal 40 to a format than can be heard by the audience member 24 and playing the audio component 20 of the performance 18 through a single user listening device 58 so it can be heard by the audience member 24, as shown in FIG. 3. In one configuration, the electronic device 56 is a WiFi capable smart phone, tablet, mini tablet or the like. Although laptops and other computing devices may be useable as the electronic device, it is likely that most audience members 24 will prefer the ease of carry and use of the smaller, hand-held electronic devices 56. In the preferred configurations of the system 10 and method 12 of the present invention, the electronic device 56 will be able to store a device application software or App 80 that assists with receiving the audio signal 40, converting the audio signal 40 back into the audio component 20 of the performance 18 and transmitting the audio component 20 to the audience member 24 through the connected, wirelessly or wired, single user listening device 58. In another embodiment, the device application software 80 will also allow the audience member 24 to transmit information back to the media transmission device 52 that will allow him or her to hear the audio component 20 of the performance 18 in a language other than English, which will allow audience members 24 who speak and hear different languages to attend the same performance 18 together.

The single user listening device 58 should be able to electronically connect to the electronic device 56 so the audio component 20 of the performance 18 can be delivered to audience member 24. Typically, the single user listening device 58 will be a pair of headphones 82 or ear buds 84, as shown in FIG. 3, that directly deliver the audio component 20 directly (or near directly) to the ear of the audience member 24. As well known in the art, the headphones 82 are generally supported by a strap or other elongated member 86 that extends over the head of the audience member 24 (as shown with regard to audience member 24*a* in FIG. 3). As such, the electronic device 56 must be configured to allow the wired single user listening device 58 to attach to the electronic device 56 in a manner that transfers the audio component 20 to the audience member 24 or the electronic device 56 must be configured to wirelessly transmit the audio component 20 to the wireless single user listening device 58 (such as via Bluetooth® or the like). The configuration and use of wired or wireless single user listening devices 58 are generally well known in art. Although the single user listening devices 58 will be for a single audience member 24 it may be possible for more than one audience member 24 to connect their listening devices 58 to the same electronic device 56. Although it is anticipated that the audience member 24 will typically bring his or her own listening device 58, the venue 16 may be able to provide listening devices 58 to audience members 24 for use during a performance 18.

Typically, the device application software 80 will be available in at least the three standard configurations with respect to mobile operating systems that are utilized with most electronic devices 56, namely Windows mobile, Android, and Apple OS. Preferably, the device application software 80 on the electronic device 56 will be able to connect to the user's preferred venue 16 based on the user's profile data in offsite mode via the internet, on Wi-Fi or via mobile networks and be able to provide traditional services such as venue schedules, the purchase of tickets, promotions, headphones and other accessories sales, and other related social media. In one embodiment, the device application software 80 will also provide the user the ability to test their Bluetooth® headphone for proper pairing and audio quality via sample audio files.

The device application software 80 in venue mode will connect to the media transmission device 52 as the user/audience member 24 enters the venue 16, assuming the application is active or prompt the user to load the application. The media transmission device 52 will verify the device application software 80 software version and prompt the user to upgrade the software if there is enough time (i.e., five minutes or more) before the performance 18 is scheduled to start. Otherwise. The media transmission device 52 will prompt the audience member 24 to upgrade his or her device application software 80 in offsite mode or after the performance 18 has ended. The software confirmation process will typically follow verification of the transaction with respect to the venue 16 and the location of the audience member 24 in the listening area 42.

If the audience member 24 is in the wrong venue 16 (i.e., the wrong movie theater) the device application software 80 can be configured to provide the audience member 24 a map to the correct venue 16 and start the process over again with respect to the software verification and venue synchronization. This process only occurs if there is more than five minutes before the performance 18 is to start. Once the audience member 24 is in the correct venue 16, the audio stream broadcasting software 72 connects with the electronic device 56 (i.e., the mobile phone) to insure there is sufficient battery capacity, verify the operational status of the wireless receiver and the Bluetooth® transmitter (as applicable), and then prompts the audience member 24 to put on their single user listening device 58 before the performance 18 starts. Typically, this will be the process five minutes or so before the performance 18 starts. The audio stream broadcasting software 72 can use the previews to insure the device application software 80 is operating properly with respect to communication and synchronization.

If there is less than five minutes before the performance 18 starts, the device application software 80 will assume the audience member 24 is in the correct venue 16 and bypass the software verification process to rapidly verify transaction to venue synchronization and start the process of broadcasting the audio signal 40. The next phase in venue mode occurs one minute before the primary performance 18 (i.e., after the previews) starts, in standard mode all other applications on the electronic device 56 close, texting and calls are automatically sent to silent or vibrate mode (per the user preference), and the screen goes dark to conserve battery life. The electronic device 56 will remain in this mode until the performance 18 ends or the audience member 24 leaves the geometric based radio technology system 10 for that venue 16. When the performance 18 ends or the audience member 24 exits the venue 16, the electronic device 56 will automatically and immediately return to its normal use state.

In other embodiments, the device application software 80 can have other functionality, as set forth above, with regard to multiple language support, family mode with one phone streaming to multiple users to simplify the setup process, parent mode providing venue to transaction control with respect to movie ratings, and improved audio quality and transmission bandwidth.

In a preferred embodiment, the method 12 of the present invention generally comprises the steps of: (1) providing a performance 18 having an audio component 20; (2) providing a venue 16 having a listening area 42 with a plurality of seating locations 44 for the performance 18; (3) admitting an audience 22 having a plurality of audience members 24 into the listening area 42 of the venue 16 with the audience members occupying some or all of the seating locations 44 to produce occupied seating locations 48; (4) determining location of the occupied seating locations 48 utilizing an audience member locating mechanism 50; (5) receiving the audio component 20 of the performance 18 into an audio control center 68; (6) utilizing a media transmission device 52 to produce an audio signal 40 from the audio component 20 of the performance 18 and a structured operating envelope 64 based on occupied seating locations 48, venue geometry 74 and audience density 76; (7) delivering the audio signal 40 to a wireless radio frequency network 54; (8) broadcasting the audio signal 40 to the listening area 42 of the venue 16 based on the structured operating envelope 64; (9) receiving the audio signal 40 by an electronic device 56 associated with one or more audience members 24; (10) processing the audio signal 40 back into the audio component 20 by the electronic device 56; and (11) transferring the audio component 20 to one of the audience members 24 with a single user listening device 58 for a high quality listening experience that substantially eliminates noise activity 60 by other audience members 24 or from other sources, as shown in FIG. 5. As set forth above, the step of determining the location of the occupied seating locations 48 by the audience member locating mechanism 50 can be accomplished utilizing assigned seating information from the venue's audience management system 62, by manually determining the occupied seating locations 48 or by using a 3D LiDAR sensor 66 or the like to scan the venue 16 to determine which seating locations 44 in the listening area 42 are occupied seating locations 48. As also set forth above, the media transmission device 52 will have audio conversion software 70 that converts the audio component 20 of the performance 18 into the audio signal 40, structured operating envelope software 78 that produces the structured operating envelope 64 and audio stream broadcasting software 72 that prepares the audio signal 40 for transmission to the wireless radio frequency network 54 by converting the audio signal 40 into a proprietary audio stream that will be easier to broadcast over the network 54, suitable to be received by the electronic devices 56 and avoid interference with other nearby venues 16. The electronic devices 56 that receive the audio signal 40 will have device application software 78 that processes the audio signal 40 back to the audio component 20 so it may be listened to by an audience member 24 through his or her single user listening device 58. The electronic device 56 may be a smart phone, tablet, mini tablet and the like having the capability to receive wireless signals, store software that can process wireless signals and transfer the audio component to the listening device 58, whether via a wired or wireless connection. The use of the method 12 of the present invention will allow an audience member 24 to better hear and enjoy the audio component 20 of a performance 18 and reduce the likelihood that noise activity 60 will interfere with such enjoyment.

A wide variety of other features can be added to the method 12 of the present invention. Such features include allowing the audience member 24 to select the language (i.e., other than English) he or she desires to hear the audio component 20 of the performance 18, verifying that the audience member 24 is in the correct venue 16, obtain time, location and related information about the venue 16 and/or the performance 18, pre-purchase tickets and/or select the seating location 44 he or she wants, upgrade the device application software 80, and the like. The method 12 of the present invention can also include the steps of verifying the device application software 80, close other open programs and applications on the electronic device 56, turn off the ability of the electronic device 56 to send or receive texts and phone calls (at least in other than silent or vibrating mode), and automatically reset the electronic device 56 to the audience member's desired operating condition once he or she leaves the venue 16 or the performance 18 has ended. As will be readily appreciated by persons skilled in the art, the above is not an exhaustive list of features that can be included with the method 12 of the present invention.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A geometrically based radio transmission system, comprising:

a performance having an audio component;

a venue for said performance, said venue having an audio control center configured to control said audio component of said performance;

a listening area in said venue;

an audience in said listening area of said venue, said audience comprising a plurality of audience members;

a plurality of seating locations in said listening area of said venue, each of said seating locations configured to receive one of said audience members, each of said seating locations having said one of said audience members being defined as an occupied seating location;

locating means associated with said venue for locating said occupied seating locations in said listening area;

a media transmission device associated with said venue and operatively connected to said locating means, said media transmission device configured to receive said audio component of said performance to produce an audio signal and to receive said occupied seating locations from said locating means to produce a structured operating envelope;

a wireless radio frequency network electronically connected to said media transmission device and structured and arranged to broadcast said audio signal to said listening area based on said structured operating envelope;

an electronic device associated with one or more of said audience members, said electronic device structured and arranged to receive said audio signal from said wireless radio frequency network and process said audio signal back into said audio component of said performance; and a single user listening device associated with each of said audience members and connected to one of said electronic devices so as to deliver said audio component of said performance directly to said audience member in a manner that reduces the likelihood of noise activity disturbing the enjoyment of said performance by each of said audience members.

2. The system of claim 1, wherein said locating means comprises at least one of data from an audience management system of said venue, manual determination and a LiDAR sensor.

3. The system of claim 2, wherein said locating means comprises said LiDAR sensor, said LiDAR sensor configured to determine a venue geometry of said venue for use by said media transmission device to produce said structured operating envelope.

4. The system of claim 1, wherein said media transmission device utilizes venue geometry and audience density to produce said structured operating envelope.

5. The system of claim 4, wherein said media transmission device receives said venue geometry from said locating means.

6. The system of claim 5, wherein said locating means is a LiDAR sensor.

7. The system of claim 1 further comprising at least one of an audio conversion software for processing said audio component into said audio signal, a structured operating envelope software for producing said structured operating envelope and an audio stream broadcasting software for preparing said audio signal for broadcasting by said wireless radio frequency network.

8. The system of claim 7, wherein one or more of said audio conversion software, said structured operating envelope software and said audio stream broadcasting software are operated by said media transmission device.

9. The system of claim 1, wherein said electronic device is one of a smart phone, a tablet and a mini tablet.

10. The system of claim 1, wherein said single user listening device is one of headphones and ear buds.

11. A geometrically based radio transmission system, comprising:

a performance having an audio component;

a venue for said performance, said venue having an audio control center configured to control said audio component of said performance;

a listening area in said venue;

an audience in said listening area of said venue, said audience comprising a plurality of audience members;

a plurality of seating locations in said listening area of said venue, each of said seating locations being sized and configured to receive one of said audience members, each of said seating locations having said one of said audience members being defined as an occupied seating location;

locating means associated with said venue for locating said occupied seating locations in said listening area, said locating means comprising at least one of data from an audience management system of said venue, manual determination and a LiDAR sensor;

a media transmission device associated with said venue and operatively connected to said locating means, said media transmission device configured to receive said audio component of said performance to produce an audio signal and to receive said occupied seating locations from said locating means to produce a structured operating envelope, said media transmission device further utilizing venue geometry and audience density to produce said structured operating envelope;

a wireless radio frequency network electronically connected to said media transmission device and structured and arranged to broadcast said audio signal to said listening area based on said structured operating envelope;

an electronic device associated with one or more of said audience members, said electronic device structured and arranged to receive said audio signal from said wireless radio frequency network and process said audio signal back into said audio component of said performance; and a single user listening device associated with each of said audience members and connected to one of said electronic devices so as to deliver said audio component of said performance directly to said audience member in a manner that reduces the likelihood of noise activity disturbing the enjoyment of said performance by each of said audience members.

12. The system of claim 11, wherein said locating means comprises said LiDAR sensor, said LiDAR sensor further configured to determine said venue geometry of said venue for use by said media transmission device to produce said structured operating envelope.

13. The system of claim 11, wherein said media transmission device receives said venue geometry from said locating means.

14. The system of claim 13, wherein said locating means is a LiDAR sensor.

15. The system of claim 11 further comprising at least one of an audio conversion software for processing said audio component into said audio signal, a structured operating envelope software for producing said structured operating envelope and an audio stream broadcasting software for preparing said audio signal for broadcasting by said wireless radio frequency network.

16. A method of providing a geometrically based radio transmission system, said method comprising the steps of:

(a) providing a performance having an audio component;

(b) providing a venue having a listening area with a plurality of seating locations for said performance;

(c) admitting an audience having a plurality of audience members into said listening area of said venue with said audience members occupying some or all of said seating locations to produce occupied seating locations;

(d) determining location of said occupied seating locations utilizing an audience member locating mechanism;

(e) receiving said audio component of said performance into an audio control center;

(f) utilizing a media transmission device to produce an audio signal from said audio component of said performance and a structured operating envelope based on occupied seating locations, venue geometry and audience density;

(g) delivering said audio signal to a wireless radio frequency network;

(h) broadcasting said audio signal to said listening area of said venue based on said structured operating envelope;

(i) receiving said audio signal by an electronic device associated with one or more audience members;

(j) processing said audio signal back into said audio component by said electronic device; and (k) transferring said audio component to one of said audience members with a single user listening device for a high quality listening experience that substantially eliminates noise activity.

17. The method of claim 16, wherein said locating means comprises at least one of data from an audience management system of said venue, manual determination and a LiDAR sensor.

18. The method of claim 17, wherein said locating means comprises said LiDAR sensor, said LiDAR sensor configured to determine a venue geometry of said venue for use by said media transmission device to produce said structured operating envelope.

19. The method of claim 16, wherein said media transmission device utilizing step further comprises performing at least one of the following: (a) utilizing an audio conversion software to process said audio component into said audio signal; (2) utilizing a structured operating envelope software to produce said structured operating envelope; and (3) utilizing an audio stream broadcasting software to prepare said audio signal for broadcasting by said wireless radio frequency network.

20. The method of claim 16 further comprising a device application software associated with said electronic device, said audio signal processing step utilizing said device application software to process said audio signal back into said audio component.

* * * * *